United States Patent [19]

Hattori et al.

[11] 4,398,976

[45] Aug. 16, 1983

[54] WATER-IN-OIL EMULSION EXPLOSIVE COMPOSITION

[75] Inventors: Katsuhide Hattori; Yoshiaki Fukatsu; Akio Torii, all of Chita, Japan

[73] Assignee: Nippon Oil and Fats Company, Limited, Tokyo, Japan

[21] Appl. No.: 333,896

[22] Filed: Dec. 23, 1981

[30] Foreign Application Priority Data

Jan. 12, 1981 [JP] Japan ..... 56-2771

[51] Int. Cl.[3] ..... C06B 45/02

[52] U.S. Cl. ..... 149/21; 149/46; 149/60; 149/70; 149/77; 149/83; 149/85

[58] Field of Search ..... 149/21, 46, 60, 70, 149/77, 83, 85

[56] References Cited

U.S. PATENT DOCUMENTS 4,322,258 3/1982 Sudweeks et al. ..... 149/2

4,326,900 4/1982 Hattori et al. ..... 149/89

*Primary Examiner*—Stephen J. Lechert, Jr.

*Attorney, Agent, or Firm*—Parkhurst & Oliff

[57] ABSTRACT

A water-in-oil emulsion explosive composition having excellent storage stability, low-temperature detonability and explosion reactivity is disclosed, which comprises (a) a disperse phase formed of an inorganic nitrate consisting mainly of ammonium nitrate, (b) a continuous phase formed of an oil, (c) an emulsifier, (d) hollow microspheres and/or a chemical foaming agent, and (e) an inorganic chlorate.

4 Claims, No Drawings

WATER-IN-OIL EMULSION EXPLOSIVE COMPOSITION

BACKGROUND OF THE INVENTION (1) Field of the Invention

The present invention relates to a water-in-oil (hereinafter, abbreviated as W/O) emulsion explosive composition containing an inorganic chlorate as a sensitizer and having excellent storage stability, low-temperature detonability and explosion reactivity.

(2) Description of the Prior Art

Conventional water-gel explosive consists mainly of an oxidizer, a reducing agent (fuel), a crosslinking agent, a sensitizer and foams. In the water-gel explosive, as the sensitizer, there have been used monomethylamine nitrate, ethylene glycol mononitrate, aluminum powder and the like; and as the oxidizer, there have been used very stable inorganic nitrate or inorganic perchlorate alone or in admixture in order to ensure the storage stability of the water-gel explosive. Further, the use of inorganic chlorate as the other oxidizer is disclosed in U.S. Patent application Ser. Nos. 3,282,753, 3,715,247 and 3,985,593. However, inorganic chlorate is very inferior in stability to the above described oxidizers, and decomposes in a very short period of time in the water-gel explosive. In order to obviate this drawback, the above described U.S. patent applications describe that it is desirable to add alkali substances, such as sodium carbonate, potassium hydroxide and the like, to the water-gel explosive in order to improve the stability during the storage of the explosive. However, the use of alkali substances in the adjustment of the pH of conventional water-gel explosive deteriorates ammonium nitrate used as a main oxidizer and hinders the development of the crosslinking ability of crosslinking agent which serves to form the water-gel explosive.

The inventors have considered that one of the causes of decomposition of inorganic chlorate in a water-gel explosive is its crystallization in an aqueous solution of ammonium nitrate, and have made various investigations in order to prevent the crystallization of inorganic chlorate. As a result, the inventors have found out that, when a W/O emulsion explosive is produced, the droplets which form the disperse phase of the emulsion and contains inorganic chlorate dissolved therein, are formed into a very small size. Therefore, the crystallization of the inorganic chlorate is suppressed and the inorganic chlorate is prevented from being decomposed, and the W/O emulsion explosive has very high low-temperature detonability and explosion reactivity due to the action of the inorganic chlorate. As a result, the present invention has been accomplished.

SUMMARY OF THE INVENTION

The feature of the present invention is the provision of a water-in-oil emulsion explosive composition comprising (a) a disperse phase formed of an aqueous solution of inorganic nitrate consisting mainly of ammonium nitrate, (b) a continuous phase formed of oil, (c) an emulsifier and (d) hollow microspheres and/or a chemical foaming agent, the improvement comprising containing (e) an inorganic chlorate.

DESCRIPTION OF THE PREFERRED EMBODIMENT

The components to be used in the W/O explosive composition of the present invention are as follows.

The disperse phase formed of an aqueous solution of inorganic nitrate consists of ammonium nitrate and water or consists of ammonium nitrate, another nitrate, such as sodium nitrate, calcium nitrate or the like, and water.

The continuous phase formed of oil consists of fuel oil and/or wax. The fuel oil includes hydrocarbons, for example, paraffinic hydrocarbon, olefinic hydrocarbon, naphthenic hydrocarbon, aromatic hydrocarbon, other saturated or unsaturated hydrocarbon, petroleum, mineral oil, lubricant, liquid paraffin and the like; and hydrocarbon derivatives, such as nitrohydrocarbon and the like. The wax includes unpurified microcrystalline wax, purified microcrystalline wax and the like, which are derived from petroleum; mineral waxes, such as montan wax, ozokerite and the like; animal waxes, such as whale wax and the like; and insect waxes, such as beeswax and the like. These fuel oil and/or wax are used alone or in admixture. The compounding amount of these fuel oil and/or wax can be determined depending upon the consistency of the resulting explosive composition.

The emulsifier is not particularly limited and includes all the commonly known emulsifiers capable of forming a W/O emulsion, for example, fatty acid esters of sorbitan, such as sorbitan monolaurate, sorbitan monooleate, sorbitan monopalmitate, sorbitan monostearate, sorbitan sesquioleate, sorbitan dioleate, sorbitan trioleate and the like; mono- or di-glycerides of fatty acid, such as stearic acid monoglyceride and the like; fatty acid esters of polyoxyethylenesorbitan, such as polyoxyethylenesorbitan monolaurate, polyoxyethylenesorbitan monostearate and the like; oxazoline derivatives; imidazoline derivatives; and the like. Among these emulsifiers, fatty acid esters of sorbitan, and oxazoline derivatives are preferably used.

The hollow microspheres and/or chemical foaming agent acts mainly as a density adjusting agent. As the hollow microspheres, use is made of inorganic hollow microspheres obtained from, for example, glass, shale, shirasu (shirasu is a kind of volcanic ash), silica, volcanic rock, sodium silicate, borax, perlite, obsidian and the like; carbonaceous hollow microspheres obtained from pitch, coal and the like; and synthetic resin hollow microspheres obtained from phenolic resin, polyvinylidene chloride, epoxy resin, urea resin and the like. These hollow microspheres are used alone or in admixture. As the chemical foaming agent, use is made of inorganic chemical foaming agents, such as alkali metal borohydride, sodium nitrite and the like; and organic chemical foaming agents, such as N,N'-dinitrosopentamethylenetetramine, azodicarbonamide, azobisisobutyronitrile and the like. These chemical foaming agents are used alone or in admixture.

The inorganic chlorates to be used in the present invention include alkali metal salts or alkaline earth metal salts of inorganic chloric acid, for example, sodium chlorate, potassium chlorate, barium chlorate, strontium chlorate and the like. These inorganic chlorates are used alone or in admixture.

The compounding recipe of the above described components can be determined by taking into consideration the oxygen balance, detonability, strength, consistency, productivity and the like as a W/O emulsion explosive composition. In general, 70–90% ("%" means % by weight) of an inorganic nitrate, 5–20% of water, 2–7% of an oil, 1–5% of an emulsifier, at least one of not more than 10% of hollow microspheres and not more than 2% of a chemical foaming agent; and 2–15% of an inorganic chlorate are mixed. When the amount of the inorganic chlorate is less than 2%, a W/O emulsion explosive composition having sufficiently high low-temperature detonability and explosion reactivity can not be obtained. While, when the amount is more than 15%, the explosive composition having a sufficiently high storage stability can not be obtained. The size of the droplet of the disperse phase in the W/O emulsion explosive composition of the present invention should be less than about 3 μm, and is preferred to be about 1 μm.

The W/O emulsion explosive composition of the present invention can be produced in the following manner.

An inorganic nitrate which consists mainly of ammonium nitrate, and an inorganic chlorate are dissolved in water at a temperature of 50°–120° C. to obtain an aqueous solution of the oxidizer salts. Separately, an oil is mixed with an emulsifier at a temperature of 50°–90° C. to obtain a homogeneous liquid mixture of the oil and the emulsifier. Then, the aqueous solution of the oxidizer salts is mixed with the homogeneous liquid mixture of the oil and the emulsifier at a temperature of 50°–120° C. under stirring, to obtain a W/O emulsion. Then, the W/O emulsion is mixed with hollow microspheres or a chemical foaming agent to adjust the density, resulting in a W/O emulsion explosive composition aimed in the present invention.

The following examples are given for the purpose of illustration of this invention and are not intended as limitations thereof. In the examples, "parts" and "%" mean by weight.

EXAMPLE 1

A W/O emulsion explosive composition having a compounding recipe shown in the following Table 1 was produced in the following manner.

To 124 parts (12.4%) of water were added 763 parts (76.3%) of ammonium nitrate and 44 parts (4.4%) of sodium chlorate, and the resulting mixture was heated to 90° C. to dissolve the nitrate and chlorate in water and to obtain an aqueous solution of the oxidizer salts. While, a mixture of 18 parts (1.8%) of sorbitan monooleate and 36 parts (3.6%) of paraffin was heated and melted to obtain a homogeneous liquid mixture of oil and emulsifier, kept at about 80° C. Into a heat-insulating vessel was charged the above described homogeneous liquid mixture of oil and emulsifier, and then the above described aqueous solution of the oxidizer salts was gradually added thereto while agitating the resulting mixture by means of a propeller blade-type agitator. After completion of the addition, the resulting mixture was further agitated at a rate of about 1,600 rpm for 5 minutes to obtain a W/O emulsion kept at about 80° C. Then, the W/O emulsion was mixed with 15 parts (1.5%) of glass hollow microspheres in a vertical type kneader while rotating the kneader at a rate of about 30 rpm, to obtain a W/O emulsion explosive composition. The resulting W/O emulsion explosive composition was molded into a shaped article having a diameter of 25 mm and a length of about 180 mm and having a weight of 100 g, and the shaped article was packed with a viscose-processed paper to form a cartridge, which was used in the following performance tests.

In the performance tests, a sample cartridge was kept in a thermostat, which was kept at a temperature of 50° C. under a relative humidity of 50%, and after a given period of days was passed, the low-temperature detonability of the sample cartridge was tested, and further the detonation velocity of the sample cartridge at the detonation temperature in the low-temperature detonability test and the detonation velocity thereof at 20° C. were measured. The test of the low-temperature detonability and the measurement of the detonation velocity at the detonation temperature in the low-temperature detonability test were carried out in the following manner. A sample cartridge was taken out from the above described thermostat; two probes were inserted into the sample cartridge; the cartridge was placed in a thermostat kept to a low temperature to bring the cartridge into a given low temperature, and then taken out from the thermostat; the probes were immediately connected to a digital counter; the explosive sample in the cartridge was initiated by a No. 6 electric blasting cap on a sand under an unconfined state; and detonation velocity of the explosive sample was measured. The detonation velocity at 20° C. was measured in the same manner as described above, except that a sample cartridge taken out from the thermostat kept at 50° C. was placed in a thermostat kept at 20° C. The density of the explosive composition was measured with respect to the sample cartridge taken out from the thermostat kept at 20° C.

The results of the tests are shown in Table 1.

EXAMPLES 2–5

A W/O emulsion explosive composition having a compounding recipe shown in Table 1 was produced according to Example 1.

In Example 2, potassium chlorate was used in place of sodium chlorate, and mineral oil was used in place of paraffin. In Example 3, barium chlorate was used in place of sodium chlorate, and oxazoline was used in place of sorbitan monooleate. In Examples 4 and 5, sodium nitrate or a mixture of sodium nitrate and potassium nitrate was used in addition to ammonium nitrate.

A sample cartridge was produced from the above obtained W/O emulsion explosive composition in the same manner as described in Example 1, and subjected to the same performance tests as described in Example 1. The obtained results are shown in Table 1.

EXAMPLES 6–8

A W/O emulsion explosive composition having a compounding recipe shown in Table 1 was produced according to Example 1.

In Example 6, silica hollow microspheres were used in place of glass hollow microspheres as a density adjusting agent. In Example 7, a lesser amount of expensive glass hollow microspheres were used to produce an explosive composition having a higher specific gravity. In Example 8, a chemical foaming agent was used in place of hollow microspheres to adjust the density of the resulting explosive composition.

A sample cartridge was produced from the above obtained W/O emulsion explosive composition in the same manner as described in Example 1, and subjected to the same performance tests as described in Example 1. The obtained results are shown in Table 1.

EXAMPLE 9

A W/O emulsion explosive composition was produced according to Example 1, except that a mixture of inorganic chlorates shown in Table 1 was used.

A sample cartridge was produced from the above obtained W/O emulsion explosive composition in the same manner as described in Example 1, and subjected to the same performance tests as described in Example 1. The obtained results are shown in Table 1.

COMPARATIVE EXAMPLES 2-6

A W/O emulsion explosive composition having a compounding recipe shown in Table 2, which did not contain an inorganic chlorate, was produced according to Example 1.

A sample cartridge was produced from the above obtained W/O emulsion explosive composition in the same manner as described in Example 1, and subjected to the same performance tests as described in Example 1. The obtained results are shown in Table 2.

TABLE 1(a)

| Compounding recipe (%) | Example 1 | 2 | 3 | 4 | 5 | 6 | 7 | 8 | 9 |
|---|---|---|---|---|---|---|---|---|---|
| Ammonium nitrate | 76.3 | 76.3 | 76.3 | 70.4 | 64.4 | 65.4 | 76.5 | 76.7 | 76.3 |
| Sodium nitrate | — | — | — | 5.0 | 5.0 | — | — | — | — |
| Calcium nitrate | — | — | — | — | 5.0 | — | — | — | — |
| Sodium chlorate | 4.4 | — | — | 5.0 | 5.0 | 11.3 | 4.5 | 5.1 | 2.2 |
| Potassium chlorate | — | 4.4 | — | — | — | — | — | — | 2.2 |
| Barium chlorate | — | — | 4.4 | — | — | — | — | — | — |
| Water | 12.4 | 12.4 | 12.4 | 12.1 | 12.8 | 13.5 | 12.5 | 12.6 | 12.4 |
| Paraffin | 3.6 | — | 3.6 | 4.0 | 4.2 | 3.8 | — | 3.7 | 3.6 |
| Mineral oil | — | 3.6 | — | — | — | — | 3.7 | — | — |
| Sorbitan monooleate | 1.8 | 1.8 | — | 2.0 | 2.1 | 1.9 | — | 1.8 | 1.8 |
| Oxazoline | — | — | 1.8 | — | — | — | 1.8 | — | — |
| Glass hollow microspheres | 1.5 | 1.5 | 1.5 | 1.5 | 1.5 | — | 1.0 | — | 1.5 |
| Silica hollow microspheres | — | — | — | — | — | 4.1 | — | — | — |
| Sodium nitrite | — | — | — | — | — | — | — | 0.1 | — |

TABLE 1(b)

| Performances | Example 1 | 2 | 3 | 4 | 5 | 6 | 7 | 8 | 9 |
|---|---|---|---|---|---|---|---|---|---|
| Number of storaged days (day) | 34 | 28 | 32 | 36 | 34 | 28 | 22 | 24 | 30 |
| Density | 1.19 | 1.21 | 1.22 | 1.20 | 1.21 | 1.21 | 1.31 | 1.20 | 1.20 |
| Low-temperature detonability (detonation temperature, °C.) | −5 | −5 | −5 | −5 | −5 | −5 | 0 | −5 | −5 |
| Detonation velocity (m/sec) | | | | | | | | | |
| at a low temperature* | 3,920 | 3,880 | 3,930 | 4,020 | 3,880 | 3,330 | 3,430 | 3,330 | 3,890 |
| at 20° C. | 4,530 | 4,320 | 4,410 | 4,450 | 4,330 | 3,650 | 3,610 | 3,710 | 4,410 |

*at the detonation temperature in the just above item

COMPARATIVE EXAMPLE 1

A water-gel explosive composition having a compounding recipe shown in the following Table 2 was produced in the following manner.

To 100 parts (10.0%) of water were added 655 parts (65.5%) of ammonium nitrate and 100 parts (10.0%) of sodium chlorate, and the resulting mixture was heated to 90° C. to dissolve the nitrate and chlorate in water to obtain an aqueous solution of the oxidizer salts. Separately, 3 parts (0.3%) of gum was dispersed in a mixture of 50 parts (5.0%) of ethylene glycol and 90 parts (9.0%) of formamide. The resulting mixture was dispersed in the above obtained aqueous solution of the oxidizer salts, and then 2 parts (0.2%) of sodium nitrite was added to the dispersion. The density of the resulting mixture was adjusted to obtain a water-gel explosive composition. The resulting water-gel explosive composition was charged into a vinyl tube so as to form a cartridge having a diameter of 25 mm, a length of about 180 mm and having a weight of 100 g. When it was intended to carried out the same performance tests as described in Example 1, sodium chlorate was crystallized out and began to decompose while generating chlorine gas, before the cartridge was placed in a thermostat kept at a temperature of 50° C. under a relative humidity of 50%.

TABLE 2(a)

| Compounding recipe (%) | Comparative example 1 | 2 | 3 | 4 | 5 | 6 |
|---|---|---|---|---|---|---|
| Ammonium nitrate | 65.5 | 80.3 | 75.1 | 75.4 | 70.3 | 76.3 |
| Sodium nitrate | — | — | 4.6 | — | 4.8 | — |
| Calcium nitrate | — | — | — | 4.7 | 4.8 | — |
| Sodium chlorate | 10.0 | — | — | — | — | — |
| Sodium perchlorate | — | — | — | — | — | 4.4 |
| Water | 10.0 | 13.1 | 13.0 | 13.0 | 12.3 | 12.2 |
| Gum | 0.3 | — | — | — | — | — |
| Ethylene glycol | 5.0 | — | — | — | — | — |
| Formamide | 9.0 | — | — | — | — | — |
| Paraffin | — | 3.4 | 3.9 | 3.6 | 4.2 | 3.7 |
| Sorbitan monooleate | — | 1.7 | 1.9 | 1.8 | 2.1 | 1.9 |
| Glass hollow microspheres | — | 1.5 | 1.5 | 1.5 | 1.5 | 1.5 |
| Sodium nitrite | 0.2 | — | — | — | — | — |

TABLE 2(b)

| Performances | Comparative example 1 | 2 | 3 | 4 | 5 | 6 |
|---|---|---|---|---|---|---|
| Number of storaged days (day) | — | 6 | 10 | 8 | 8 | 12 |
| Density | — | 1.18 | 1.21 | 1.20 | 1.19 | 1.18 |
| Low-temperature detonability (detonation temperature, °C.) | — | +20 | +5 | +5 | +5 | +10 |
| Detonation velocity (m/sec) | | | | | | |
| at a low temperature* | — | 4,130 | 3,290 | 3,300 | 3,180 | 3,310 |

TABLE 2(b)-continued

| Performances | Comparative example 1 | 2 | 3 | 4 | 5 | 6 |
|---|---|---|---|---|---|---|
| at 20° C. | — | 4,130 | 3,880 | 4,100 | 4,000 | 3,920 |

*At the detonation temperature in the just above item

The results of Examples will be explained in comparison with the results of Comparative examples. The W/O emulsion explosive compositions of the present invention (Examples 1–9) have a storage life of 22–36 days under a condition of a temperature of 50° C. and a relative humidity of 50%, within which life the explosive compositions can be detonated at a temperature of from −5° C. to 0° C. While, the water-gel explosive composition of Comparative example 1 begins to decompose before the explosive composition is exposed to the above described test condition, and is too poor to be discussed with respect to its storage stability. Further, the conventional W/O emulsion explosive compositions (Comparative examples 3–5) containing no inorganic chlorate do not detonate at −5° C., and have a storage life of 8–10 days under the above described condition, within which life the explosive compositions can be detonated at a temperature of as high as +5° C., and which life is as short as about ½–¼ of the storage life of the W/O emulsion explosive compositions of the present invention.

The conventional W/O emulsion explosive composition (Comparative example 6) does not detonate even at a high temperature of +5° C. and has a storage life of only 10 days under the above described condition, within which life the explosive composition can be detonated at +10° C. Further, the conventional W/O emulsion explosive composition (Comparative example 2) does not detonate at a temperature lower than the high temperature of +20° C., and has a storage life of only 6 days under the above described condition, within which life the explosive composition can be detonated at 20° C.

It is clear from the above described comparison that the W/O emulsion explosive composition of the present invention is excellent in the storage stability and further is remarkably excellent in the low-temperature detonability and explosion reactivity.

What is claimed is:

1. A water-in-oil emulsion explosive composition comprising (a) a disperse phase formed of an aqueous solution of inorganic nitrate consisting mainly of ammonium nitrate, (b) a continuous phase formed of an oil, (c) an emulsifier, (d) hollow microspheres and/or a chemical foaming agent, and (e) 2–15% by weight of an inorganic chlorate sensitizer.

2. A composition according to claim 1 wherein said inorganic chlorate sensitizer is selected from the group consisting of alkali metal salts and alkaline earth metal salts of inorganic chloric acid.

3. A water-in-oil emulsion explosive composition consisting essentially of (a) a disperse phase formed of an aqueous solution of inorganic nitrate consisting mainly of ammonium nitrate, (b) a continuous phase formed of an oil, (c) an emulsifier, (d) hollow microspheres and/or a chemical foaming agent, and (e) 2–15% by weight of an inorganic chlorate sensitizer.

4. A water-in-oil emulsion explosive composition comprising (a) a disperse phase formed of an aqueous solution of inorganic nitrate consisting mainly of ammonium nitrate, (b) a continuous phase formed of an oil, (c) an emulsifier, (d) hollow microspheres and/or a chemical foaming agent, and (e) 2–15% by weight of an inorganic chlorate as the only sensitizer.

* * * * *